US005381770A

United States Patent [19]

Marthaler

[11] Patent Number: 5,381,770

[45] Date of Patent: Jan. 17, 1995

[54] BREAKOVER THROTTLE LEVER

[75] Inventor: Michael J. Marthaler, Nashville, Ind.

[73] Assignee: Cummins Engine Company, Inc., Columbus, Ind.

[21] Appl. No.: 124,585

[22] Filed: Sep. 22, 1993

[51] Int. Cl.[6] ..... F02D 7/00

[52] U.S. Cl. ..... 123/400; 123/198 DB

[58] Field of Search ..... 123/400, 198 DB, 396, 123/365, 198 D, 359

[56] References Cited

U.S. PATENT DOCUMENTS

| | | | |
|---|---|---|---|
| 1,522,764 | 1/1925 | Welker | 123/400 |
| 2,571,571 | 10/1951 | Hanners et al. | 123/400 |
| 2,575,901 | 11/1951 | Wheeler | 123/400 |
| 3,760,786 | 9/1973 | Marsh | 123/198 DB |
| 4,884,544 | 12/1989 | Sheppard | 123/400 |
| 4,928,647 | 5/1990 | Villanyi et al. | 123/400 |
| 4,947,814 | 2/1990 | Villanyi et al. | 123/396 |
| 4,979,478 | 12/1990 | Sheppard | 123/400 |
| 5,131,363 | 7/1992 | Ganser | 123/398 |
| 5,134,979 | 8/1992 | Pfalzgraf | 123/399 |
| 5,191,866 | 3/1993 | Tosdale | 123/400 |
| 5,215,057 | 6/1993 | Sato et al. | 123/400 |
| 5,297,521 | 3/1994 | Sasaki et al. | 123/396 |
| 5,297,522 | 3/1994 | Buchl | 123/399 |

*Primary Examiner*—Raymond A. Nelli

*Attorney, Agent, or Firm*—Sixbey, Friedman, Leedom & Ferguson

[57] ABSTRACT

A compact, short stroke breakover throttle lever assembly which prevents damage to high pressure internal combustion engine fuel pumps is provided. The compact, short stroke breakover throttle lever of the present invention includes a throttle lever element and a throttle control link element which are coaxial and move synchronously with a fuel pump throttle shaft that are pivotally connected at an end of the throttle lever element a maximum distance from the fuel pump throttle shaft. A central throttle control link connection and return spring connection are provided on the throttle control link element. The pivotal movement of the throttle control link element relative to the throttle lever element is limited by the travel limits of a spring engaging element which cooperates with a spring to hold the throttle lever element and throttle control link element in alignment.

11 Claims, 2 Drawing Sheets

BREAKOVER THROTTLE LEVER

TECHNICAL FIELD

The present invention relates generally to throttle levers for internal combustion engines and specifically to a breakover throttle lever which avoids damage to the fuel pump and associated structures when excessive force is applied to the throttle lever.

BACKGROUND OF THE INVENTION

Throttle operating devices have long been employed in automotive and other vehicular internal combustion engines. These operating devices typically include a throttle lever attached to a throttle shaft and operatively connected to an associated throttle control linkage. The throttle control linkage is operatively connected to a foot-operated throttle pedal or "accelerator" or to another type of operator-actuated throttle control element within the vehicle's passenger compartment. This permits the operator to control the action of a fuel supply system, such as a fuel injection system or throttle valve, through the throttle control linkage and associated throttle lever simply by pressing down or releasing the throttle pedal or by moving the throttle control element.

Throttle levers are normally arranged to move between two positions: an idle position wherein sufficient fuel is supplied to the engine so that it will run at a predetermined idling speed, and a full throttle position wherein a maximum amount of fuel is supplied to the engine. The idle and full throttle positions are normally defined by adjustable stops. When the accelerator is fully depressed or the throttle control element is fully advanced, the fuel supply control is in a full throttle position, and the engine is capable of running at a high speed. A return spring is typically used to bias the throttle lever to the setting required to maintain a preset engine idle speed when pressure on the throttle pedal is released or when the throttle control is fully retracted.

Various structures have been proposed to insure control over engine throttling and to avoid the creation of an "uncontrolled" engine wherein the operator loses control over the position of the throttle shaft. One circumstance which can overstress the throttle lever and potentially lead to loss of throttle shaft control occurs when the throttle shaft encounters a stop while continued advancing force is applied to the throttle lever through the throttle control linkage. Typically a "breakover" mechanism is provided in situations of this sort to protect the throttle shaft against such excessive force. The throttle lever breakover capability will be activated when, for example, a vehicle driver continues to exert force on an accelerator pedal or throttle control element after the throttle shaft has reached its full throttle position.

Two part throttle levers, one part of which is pivotally mounted with respect to the other to form a lever link, are normally used to provide the breakover function. The lever link is able to move or "break over" independently of the throttle lever when conditions require breakover capability. A torsion spring is typically provided on the throttle lever to urge the lever link toward its normal position and to return the lever link to its normal position upon release of the breakover causing force.

High pressure fuel pump throttle shafts and components are particularly susceptible to damage if a throttle lever is not capable of independent movements in response to a breakover-causing force.

The prior art has proposed various types of throttle levers with breakover functions that limit breakover travel or return the engine throttle system to the idle position. For example, in U.S. Pat. No. 3,760,786 to Marsh, a throttle return system is disclosed, including a two part lever and a coiled safety spring, which returns a throttle valve to the desired idle setting in the event of a failure of either the throttle return spring or the associated throttle control linkage. The central pivot connection of the two levers in this system allows a long travel distance between the idle and full throttle positions. Consequently, this system does not function as efficiently as might be desired, and the distance the throttle linkage elements are required to travel, particularly in the event of a malfunction, could damage the fuel pump internal components.

One known throttle lever design includes a one way breakover mechanism to permit over travel of the throttle linkage when the throttle shaft reaches its full throttle position. This known design includes a torsion spring for biasing a link lever toward its normal operating position and for transmitting the spring biasing force to the link lever. A stop pin, mounted on the link lever, is arranged to be engaged by one end of the torsion spring and to form a stop to define the normal operating position of the link lever relative to the throttle lever. This throttle lever design has some limitations, however. It can be installed by the end user in a way that may overstress the throttle lever torsion spring and cause it to break. As in the design disclosed in the Marsh patent, the throttle lever and link lever are pivotally connected by a centrally located pivotal connector, which produces a long travel stroke.

U.S. Pat. No. 4,928,647 to Villanyi et al. discloses a reliable dual-acting double breakover throttle lever which overcomes some of the disadvantages of the foregoing throttle lever design and provides breakover capability in both idle and full throttle conditions. However, the central pivotal connection of this assembly also produces a long travel stroke and requires longer throttle control linkages than may be desirable in some engine applications.

The throttle assemblies of the prior art typically provide a relatively large amount of "play" in the travel of the throttle lever and associated assembly components. To achieve this, the accelerator pedal or throttle control must be several inches from the floor of the vehicle, and connecting linkage structures are somewhat long and cumbersome. Reduction of the travel distance of the throttle lever and associated structures would provide a more compact and more efficient fuel throttling assembly.

The prior art, therefore, has failed to provide an efficient short stroke breakover throttle lever assembly for use with an internal combustion engine high pressure fuel pump that is capable of allowing overtravel of the throttle rod or linkage without damage to the fuel pump throttle lever or internal pump components.

SUMMARY OF THE INVENTION

It is a primary object of the present invention, therefore to overcome the disadvantages of the prior art and to provide a short stroke breakover throttle lever for an internal combustion engine high pressure fuel pump which allows overtravel of the throttle rod or linkage without damage to the fuel pump throttle lever or internal pump components.

It is another object of the present invention to provide a compact breakover throttle lever assembly which has a short travel stroke.

It is yet another object of the present invention to provide a breakover throttle lever assembly with a pivotal connection located to minimize lever travel and still provide breakover capability.

It is a further object of the present invention to provide a short stroke throttle lever assembly which travels a shorter distance from an idle position to a full throttle position than available throttle lever assemblies.

The foregoing objects are achieved by providing a breakover throttle lever assembly for an internal combustion engine high pressure fuel pump which includes two lever elements pivotally connected at a point farthest from the fuel pump throttle shaft and held in coaxial alignment by a spring member. A throttle rod connection positioned centrally between the pivotal lever connection and the fuel pump connection connects one of the lever elements to the engine throttle pedal so that only a short travel distance between the idle and full throttle positions is required. The connected lever element pivots to a breakover position only if a predetermined force is applied to the throttle rod connection point which overcomes the force of the spring member.

Other objects and advantages will be apparent from the following description, claims and drawings.

DETAILED DESCRIPTION OF THE PREFERRED EMBODIMENTS

The breakover throttle lever assembly of the present invention is intended to be operably connected to the throttle shaft of a high pressure fuel pump in an internal combustion engine to rotate the throttle shaft between full throttle and idle positions in response to forces exerted on the throttle lever by an engine throttle control, such as an accelerator pedal, and a throttle return spring. Unless precautions are taken, a situation could arise in which continued application of force to the throttle control by a human operator could damage the throttle lever assembly and allow the throttle shaft to assume a full throttle position. Internal combustion engine designers have tried to avoid this problem by providing a breakover mechanism which prevents the throttle lever from remaining in the full throttle position in the event of damage to the throttle control or linkage mechanism without permitting excessive force to be applied to the fuel pump throttle lever. The breakover throttle lever assembly of the present invention effectively allows overtravel of the throttle rod or linkage without damage to the throttle lever or internal components of a high pressure fuel pump. The present breakover throttle lever provides both a short lever stroke and breakover capability.

Figure 1:
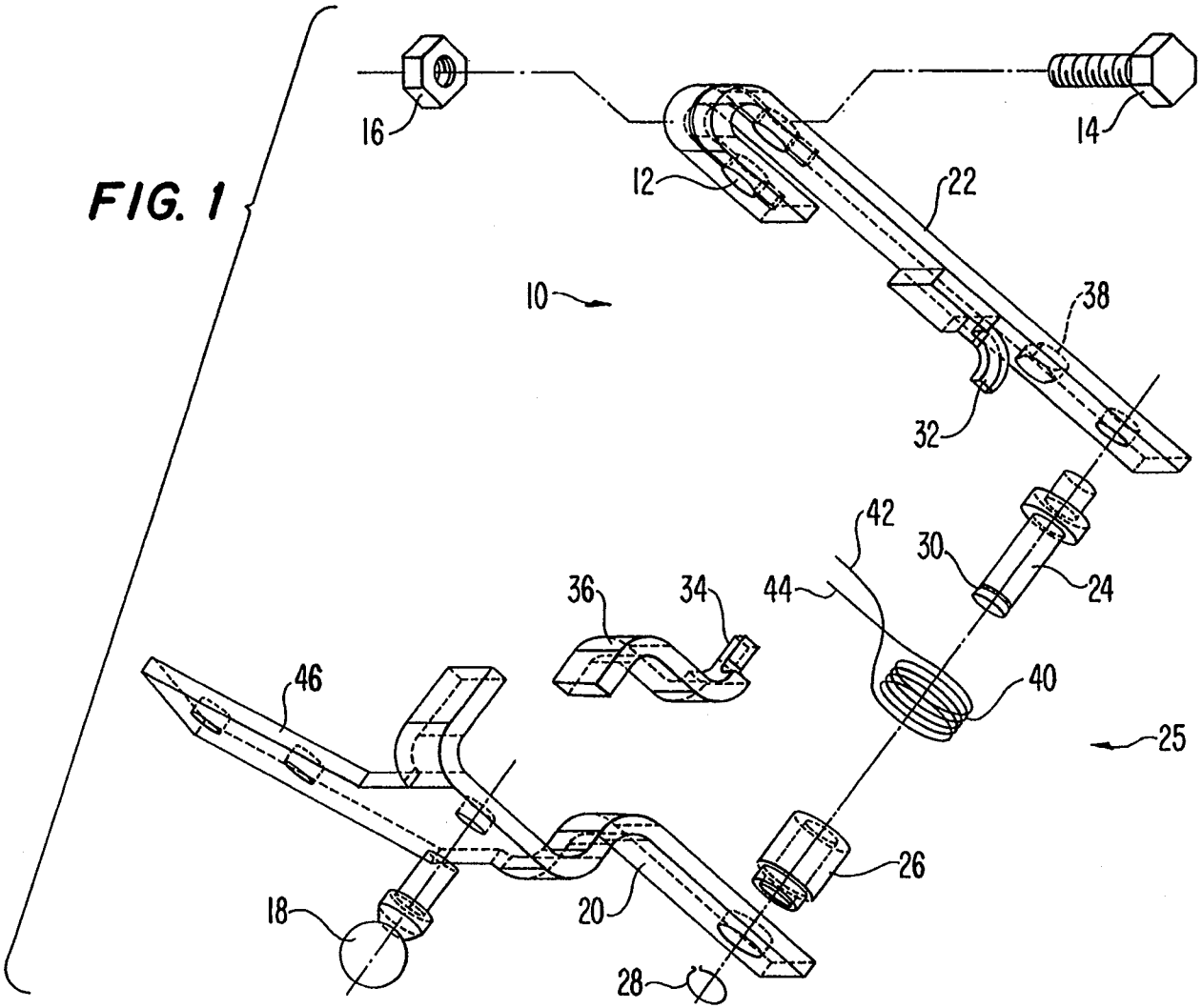
FIG. 1 is an exploded perspective view of the breakover throttle lever assembly of the present invention in an unassembled condition.

Referring to the drawings, FIG. 1 illustrates, in exploded perspective view, the unassembled components of the breakover throttle lever assembly 10 of the present invention. The breakover throttle lever assembly 10 is attached to the throttle shaft (not shown) of a fuel pump (not shown) at a splined hole 12 and is secured to the throttle shaft by a bolt 14 and a nut 16. A throttle rod linkage (not shown) from the vehicle throttle pedal or throttle control (not shown) is attached to the assembly 10 at a ball joint 18.

The assembly includes two main lever elements 20 and 22. The main lever elements are pivotally by a pivotal connection 25, which includes a shaft 24, that is secured, preferably by welding, to lever element 22, and a bushing 26. The bushing 26 is attached, preferably by welding, to throttle control lever element 20. The two main lever elements are then secured together by a clip 28 which fits into a groove 30 in shaft 24.

Figure 4:
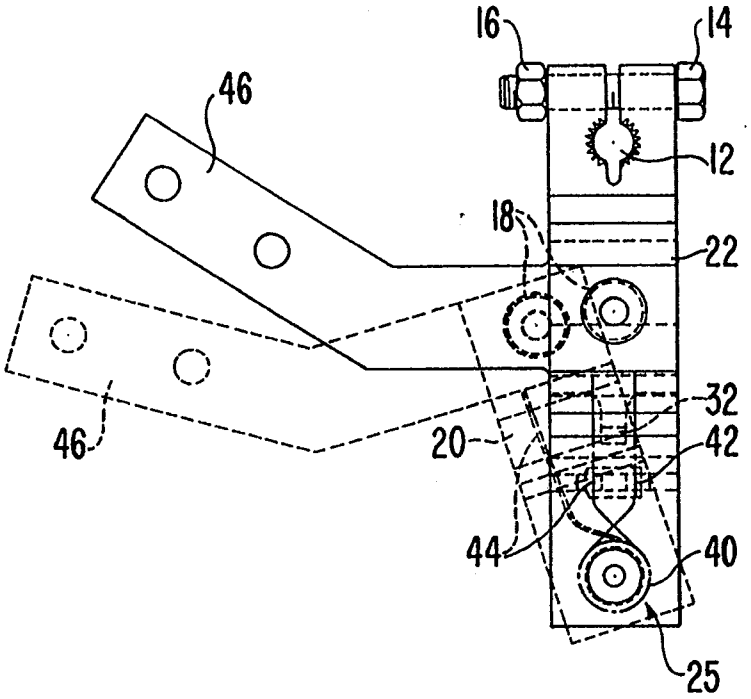
FIG. 4 is a top view of the breakover throttle lever assembly of FIG. 2 in a breakover position.
Figure 2:
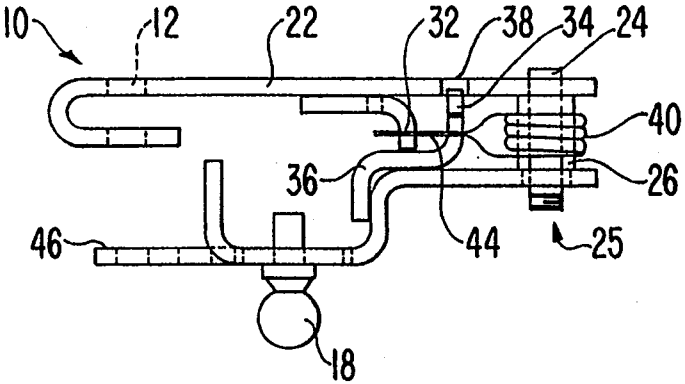
FIG. 2 is a side view of the breakover throttle lever assembly of the present invention in an assembled condition.
Figure 3:
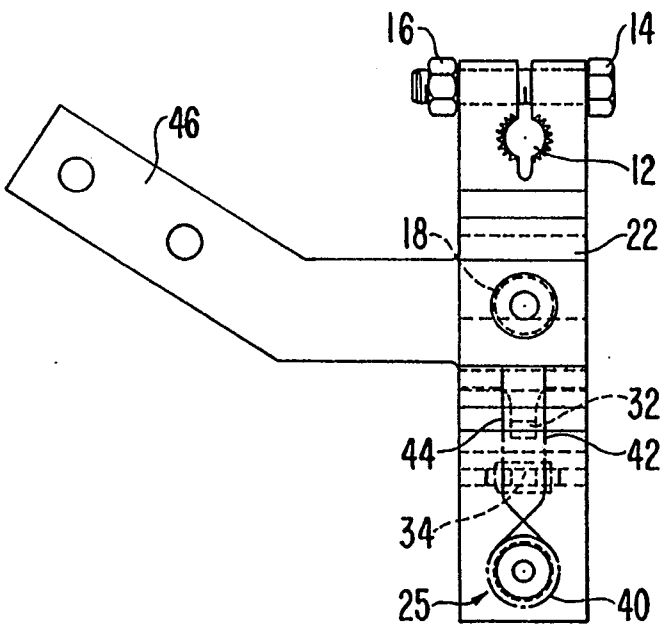
FIG. 3 is a top view of the breakover throttle lever assembly of FIG. 2 in its normal position.

Main lever element or throttle lever element 22 which will usually be positioned upwardly of lever element 24, includes a projecting tab 32, which may be integrally formed with the lever element or a separate structure secured to the lever element by welding or the like. A second projecting tab 34 is formed on a spacer link 36. This second projecting tab 34 extends in a direction opposite that of projecting tab 32 and is keyed to project through an aperture 38 in the main lever element 22 when the breakover throttle lever assembly is assembled as shown in FIGS. 2, 3 and 4. The dimensions of the aperture 38 limit the movement of the tab 34 and, therefore, the movement of the throttle control lever element 20.

A torsion spring 40 is positioned about the bushing 26 and shaft 24 pivotal connection 25 between the main lever elements 20 and 22. The torsion spring 40 is formed with substantially straight legs 42 and 44, which contact the projecting tabs 32 and 34 when the components of the breakover throttle lever assembly are operably assembled to hold the main lever elements 20 and 22 in coaxial alignment.

The components of the throttle lever assembly 10 are preferably formed of steel which has been cold rolled and carburized. Steel with the designations 1010, 1018 and the like are particularly suitable for the present breakover throttle lever assembly.

The two main lever elements 20 and 22 are held in place against pivotal movement about the pivotal connection 25 by the force of the legs 42 and 44 of the torsion spring 40 on the projecting tabs 32 and 34. These lever elements move synchronously about the fuel pump throttle shaft (not shown) and are prevented from pivoting about the pivotal connection 25 unless a force in excess of a predetermined force, which is the force of the torsion spring 40, is applied to the throttle lever assembly. Such force typically is applied to the ball joint 18, which is connected through appropriate linkages (not shown) to the operator-actuated throttle pedal or throttle control. In the event one of the legs 42 or 44 broke or became separated from the tabs 32 and 34, the movement of throttle control lever 20 relative to throttle lever 22 would be limited by the lateral movement of tab 34 in aperture 38.

The legs 42 and 44 of torsion spring 40 operate in a scissors manner to hold the tabs 32 and 34 and, thus, the main lever elements 20 and 22, in alignment until a force exceeding the predetermined force has been applied to the ball joint 18. When this occurs, the throttle control lever 20 pivots about the pivotal connection 25 while the throttle lever 22 does not. This prevents the movement of the fuel pump throttle shaft to an undesired full throttle position. Throttle control lever 20 is formed with a winged extension 46, which is positioned substantially coplanar to the ball joint 18 and is connected to a redundant return spring (not shown) that returns the throttle control lever to the position shown in FIG. 3 when the force on the throttle control lever 20 is equal to or less than the force of the spring 40. This arrangement allows overtravel of the throttle rod or linkage attached at ball joint 18 without damaging the fuel pump throttle shaft or the fuel pump internal components.

FIG. 4 illustrates the throttle lever assembly of the present invention in a breakover position, which is shown in dashed lines.

In distinct contrast to available breakover throttle lever designs, in which the main lever elements are pivotally connected at a point that is approximately at the center of the lever between the fuel pump throttle shaft and the lever end, the main lever elements 20 and 20 of the present invention are pivotally connected at a point, connection 25, that is as far from the fuel pump throttle shaft as possible. The throttle control linkage connection is then provided at ball joint 18, which is centrally positioned between the pivotal connection 25 and the fuel pump throttle shaft. This arrangement produces a significantly shorter travel distance than available breakover throttle levers, in part because the workable end of the throttle lever is out of the center. The lever stroke is shortened without sacrificing breakover capability. When the assembly 10 is functioning normally, both main lever elements 20 and 22 pivot about the fuel pump throttle shaft. If there is still travel space left after the internal fuel pump stop is contacted by the breakover throttle lever assembly, the arrangement of the present invention provides some "play" so that the internal pump components are not damaged.

Because the throttle lever assembly has a short travel distance from idle to full throttle, the assembly and its associated linkages are more compact. The long connecting rods required by the prior art are not needed. Instead, significantly shorter connecting rods can be used to produce a short stroke with breakover capability. The winged extension 46, which is attached to a redundant return spring (not shown), also requires shorter connections than those previously required so that this arrangement functions more efficiently. Moreover, the fuel pedal, accelerator or other throttle control must move only a short distance between idle and full throttle.

INDUSTRIAL APPLICABILITY

The breakover throttle lever assembly of the present invention will find its primary use as a component of an internal combustion engine throttle control system to assure optimum throttling function while avoiding damage to the fuel pump throttle shaft and components in the event excess force is applied to the throttle assembly control or linkage structures.

I claim:

1. A throttle lever assembly for operating a throttle shaft adapted to control the flow of fuel to an internal combustion engine as the throttle shaft is moved between an idle position and a full throttle position in response to a throttle control, comprising:

(a) a throttle lever means adapted to be connected with the throttle shaft for moving the throttle shaft between the idle and full throttle positions in response to movement of the throttle control;

(b) throttle link means connected to said throttle lever and to the throttle control for limiting the degree of force which may be applied to said throttle lever means when the throttle shaft reaches at least one of said idle and full throttle positions;

(c) pivotal connector means located at a point on said throttle lever means a maximum distance from said throttle shaft for pivotally connecting said throttle lever means and said throttle link means; and (d) throttle control connector means located on said throttle link means substantially centrally between said pivotal connector means and said throttle shaft for engaging a linkage element in said throttle control.

2. The throttle lever assembly described in claim 1, wherein said pivotal connector means includes a spring biasing means for biasing said throttle lever means and said throttle link means into a normal operating position wherein said throttle lever means and said throttle link means are axially aligned and rotate synchronously with said throttle shaft.

3. The throttle lever assembly described in claim 2, wherein said throttle lever means includes a first spring engaging portion and said throttle link means includes a second spring engaging portion and said spring biasing means includes a spring having a pair of legs, wherein one of said legs is engaged by said first spring engaging portion and the other of said legs is engaged by said second spring engaging portion.

4. The throttle lever assembly described in claim 3, wherein said throttle lever means includes aperture means for receiving said second spring engaging portion, wherein said aperture means is sized relative to said second spring engaging portion to limit the lateral movement thereof in the event said leg of said spring is prevented from contacting said second spring engaging portion.

5. The throttle lever assembly described in claim 2, wherein said throttle control connector means includes a connector element which engages a linkage member operatively connected to the throttle control.

6. The throttle lever assembly described in claim 5, wherein said throttle control connector means further includes a winged extension coplanar with said throttle link means, wherein said winged extension is connected to a return spring to bias said throttle link means to a normal operating position wherein said throttle link means is coaxial and aligned with said throttle lever means.

7. The throttle lever assembly described in claim 4, wherein said second spring engaging portion is formed on a link member configured to conform to the configuration of said throttle link means and secured to said throttle link means so that said second spring engaging portion keys into said aperture means when said throttle lever is assembled.

8. The throttle lever assembly described in claim 6, wherein said throttle link means is rotatable from said normal operating position to a breakover position when the force on said throttle control connector means exceeds the force of said spring biasing means.

9. The throttle lever assembly described in claim 2, wherein said pivotal connector means includes shaft means for pivotally connecting said throttle lever means and said throttle link means and spacer means exteriorly of said shaft means for maintaining a sufficient distance between said throttle lever means and said throttle link means to receive said spring biasing means and accommodate the height thereof.

10. The throttle lever assembly described in claim 5, wherein said connector element has a rounded ball-shaped configuration.

11. A throttle lever assembly for operating a throttle shaft adapted to control the flow of fuel to an internal combustion engine as the throttle shaft is moved between an idle position and a full throttle position in response to movement of a throttle control, wherein said assembly includes:

(a) a throttle lever element pivotally connected to a throttle control link element and to said throttle shaft so that said throttle lever element and said throttle control link element are held by a spring member in coaxial alignment to move synchronously with said throttle shaft by a pivotal connector positioned at an end of the throttle lever element distal from a throttle shaft connection;

(b) a throttle control connector located on the throttle control link element at a position centrally between the throttle shaft and the pivotal connector to provide an operable connection to the throttle control; and (c) a return spring connector substantially coplanar with the throttle control connector, wherein the pivotal movement of the throttle control link element relative to the throttle lever element between normal and breakover positions is limited by a spring member engaging element to limit the stroke of the throttle lever assembly.

* * * * *